US008925342B2

(12) United States Patent
Son et al.

(10) Patent No.: US 8,925,342 B2
(45) Date of Patent: Jan. 6, 2015

(54) REFRIGERATOR

(75) Inventors: Juhyun Son, Gyeongsangnam-do (KR); Wookyong Lee, Gyeongsangnam-do (KR); Donghoon Lee, Gyeongsangnam-do (KR); Dongjeong Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 203 days.

(21) Appl. No.: 13/612,934

(22) Filed: Sep. 13, 2012

(65) Prior Publication Data

US 2013/0067947 A1 Mar. 21, 2013

(30) Foreign Application Priority Data

Sep. 16, 2011 (KR) ..... 10-2011-0093336

(51) Int. Cl.
*F25C 5/18* (2006.01)
*F25C 5/00* (2006.01)

(52) U.S. Cl.
CPC ..... *F25C 5/005* (2013.01); *F25C 2400/04* (2013.01)
USPC ..... 62/344

(58) Field of Classification Search
CPC ..... F25C 1/04; F25C 1/225; F25C 5/005; F25C 2400/10; F25C 2400/14; F25C 2400/04; F25D 3/04; F25D 3/02
USPC ..... 62/132, 340, 344, 379
See application file for complete search history.

(56) References Cited

U.S. PATENT DOCUMENTS

| | | | | |
|---|---|---|---|---|
| 4,285,212 | A * | 8/1981 | Prada | 62/344 |
| 5,442,933 | A | 8/1995 | Unger | |
| 6,148,624 | A * | 11/2000 | Bishop et al. | 62/137 |
| 6,351,958 | B1 | 3/2002 | Pastryk | |
| 7,188,479 | B2 * | 3/2007 | Anselmino et al. | 62/66 |
| 7,426,838 | B1 | 9/2008 | Shapiro | |
| 2005/0257536 | A1 * | 11/2005 | Chung et al. | 62/135 |
| 2006/0086130 | A1 | 4/2006 | Anselmino | |
| 2006/0201189 | A1 * | 9/2006 | Adamski et al. | 62/334 |
| 2009/0193832 | A1 | 8/2009 | Lee | |

FOREIGN PATENT DOCUMENTS

| | | | |
|---|---|---|---|
| DE | 20321896 | U1 | 5/2012 |
| EP | 1 653 174 | A2 | 5/2006 |
| JP | S 46-029809 | Y1 | 10/1971 |
| JP | H 01-196477 | A | 8/1989 |

(Continued)

OTHER PUBLICATIONS

Chinese Office Action for Application No. 201210310243.6 dated May 28, 2014 with English Translation, 10 pages.

*Primary Examiner* — Melvin Jones
(74) *Attorney, Agent, or Firm* — Fish & Richardson P.C.

(57) ABSTRACT

Provided is a refrigerator. The refrigerator includes a cabinet including a refrigerating compartment and a freezing compartment, a refrigerating compartment door opening or closing the refrigerating compartment, a dispenser disposed at the refrigerating compartment door to dispense water or ice pieces. The refrigerator also includes an ice bank disposed at a back surface of the refrigerating compartment door to supply the ice pieces to the dispenser, an ice maker disposed in the freezing compartment to make the ice pieces, and an ice transfer device disposed in the freezing compartment to transfer the ice pieces supplied from the ice maker into the ice bank. The ice transfer device includes a piston pushing the ice pieces supplied from the ice maker and an ice chute guiding the ice pieces supplied by the piston to the ice bank.

18 Claims, 11 Drawing Sheets

(56) References Cited

FOREIGN PATENT DOCUMENTS

| | | | |
|---|---|---|---|
| JP | S 38-04008 | B2 | 3/1993 |
| JP | H 06-278702 | A | 10/1994 |
| JP | 2004-354037 | A | 12/2004 |
| JP | 2005 090935 | A | 4/2005 |
| JP | 2007 132644 | A | 5/2007 |
| JP | 2010 071564 | A | 4/2010 |
| KR | 10-2005-0028227 | A | 3/2005 |
| KR | 10-2011-0037609 | A | 4/2011 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2011-0093336 (Sep. 16, 2011), which is hereby incorporated by reference in its entirety.

FIELD

This disclosure relates to refrigerator technology.

BACKGROUND

In general, refrigerators are home appliances for storing foods at a low temperature in an inner storage space covered by a door. That is, since such a refrigerator cools the inside of a storage space using cool air generated by heat-exchanging with a refrigerant circulating a refrigeration cycle, foods stored in the storage space may be stored in an optimum state.

Also, an ice maker for making ice pieces may be provided inside the refrigerator. The ice maker is configured so that water supplied from a water supply source or a water tank is received into an ice tray to make ice pieces.

Also, a dispenser for dispensing purified water or ice pieces made in the ice maker to the outside may be provided in the refrigerating compartment door.

SUMMARY

In one aspect, a refrigerator includes a cabinet comprising a refrigerating compartment and a freezing compartment, a refrigerating compartment door configured to open and close at least a portion of the refrigerating compartment, and a dispenser disposed at the refrigerating compartment door and configured to dispense ice pieces. The refrigerator also includes an ice bank disposed at a back surface of the refrigerating compartment door to supply the ice pieces to the dispenser, an ice maker disposed in the freezing compartment and configured to make the ice pieces, and an ice transfer device disposed in the freezing compartment and configured to transfer the ice pieces made by the ice maker to the ice bank. The ice transfer device includes a piston configured to push the ice pieces made by the ice maker and an ice chute configured to guide the ice pieces pushed by the piston to the ice bank.

Implementations may include one or more of the following features. For example, the ice chute may extend from the ice transfer device to the refrigerating compartment and may communicate with the ice bank in a state where the refrigerating compartment door is closed. In this example, the ice chute may return cool air supplied into the ice bank to the freezing compartment. In addition, the refrigerator may include a cool air duct that extends from the freezing compartment to the refrigerating compartment, that communicates with the ice bank in a state where the refrigerating compartment door is closed, that is disconnected from the ice bank in a state where the refrigerating compartment door is open, and that supplies cool air from within the freezing compartment to the ice bank.

In some implementations, at least one portion of the ice transfer device is positioned within an insulation material between an outer case defining an outer appearance of the cabinet and an inner case defining an inner space of the refrigerator. Also, the ice transfer device may include a storage member configured to store the ice pieces made by the ice maker and a housing configured to receive an ice piece transported from the storage member. The piston may be positioned at least partially in the housing and may reciprocate to push the ice piece received in the housing.

The driving unit may include a motor configured to generate a rotation power and a link member that connects the motor to the piston and that is configured to convert a rotation motion of the motor into a linear reciprocating motion that drives the piston. A top surface of the piston may be inclined in a manner that guides ice pieces transported from the storage member toward a front side of the piston that is appropriate for being pushed toward the ice chute by the piston.

Further, the refrigerator may include a shutter positioned within the housing and configured to selectively open and cover a front opening of the housing. The front opening of the housing may be an opening through which ice pieces exit the housing when pushed toward the ice chute by the piston. The shutter may be rotated to open the front opening of the housing based on reciprocation of the piston. The shutter also may be configured to block ice pieces that have exited the front opening of the housing from reentering the front opening of the housing.

In some examples, the refrigerator may include a rib that protrudes upward from a front end of the piston and that engages the shutter during reciprocation of the piston to guide rotation of the shutter in a direction that opens the front opening of the housing. In these examples, the shutter may include a shutter groove in which the rib is received during reciprocation of the piston and a guide protrusion extending from each of both sides surfaces. Further, in these examples, a top surface of the piston may have a receiving groove that is recessed from the top surface of the piston at each of left and right sides of the rib and that defines an insertion area in which an end of the shutter is inserted during reciprocation of the piston.

In some implementations, the ice maker may include an upper tray comprising a plurality of hemispherical recess parts recessed upward and a lower tray comprising a plurality of hemispherical recess parts recessed downward and being rotatably coupled to the upper tray. In these implementations, the lower tray may be configured to attach to the recess parts of the upper tray to define a spherical shell. Also, in these implementations, the ice chute may have a diameter that corresponds to a size of the spherical shell used in making ice pieces.

Further, the refrigerator may include a blow fan positioned at an inlet of the cool air duct and configured to promote movement of cool air into the ice bank. The refrigerator also may include an ice detection device positioned in at least one of the ice bank and the storage member and configured to detect whether a set amount or more of the ice pieces is filled.

In some examples, the refrigerator may include a door sensor configured to detect opening or closing of the refrigerating compartment door. In these examples, an operation of the piston may be restricted according to the opening or closing of the door detected by the door sensor. Further, in these examples, the piston may be disabled based on the door sensor detecting opening of the refrigerating compartment door.

The dispenser may be disposed in the refrigerating compartment door and the ice bank may be disposed in the back surface of the refrigerating compartment door. The dispenser may be disposed on the refrigerating compartment door and the ice bank may be disposed on the back surface of the refrigerating compartment door.

The details of one or more implementations are set forth in the accompanying drawings and the description below. Other features will be apparent from the description and drawings, and from the claims.

DETAILED DESCRIPTION

Figure 1:
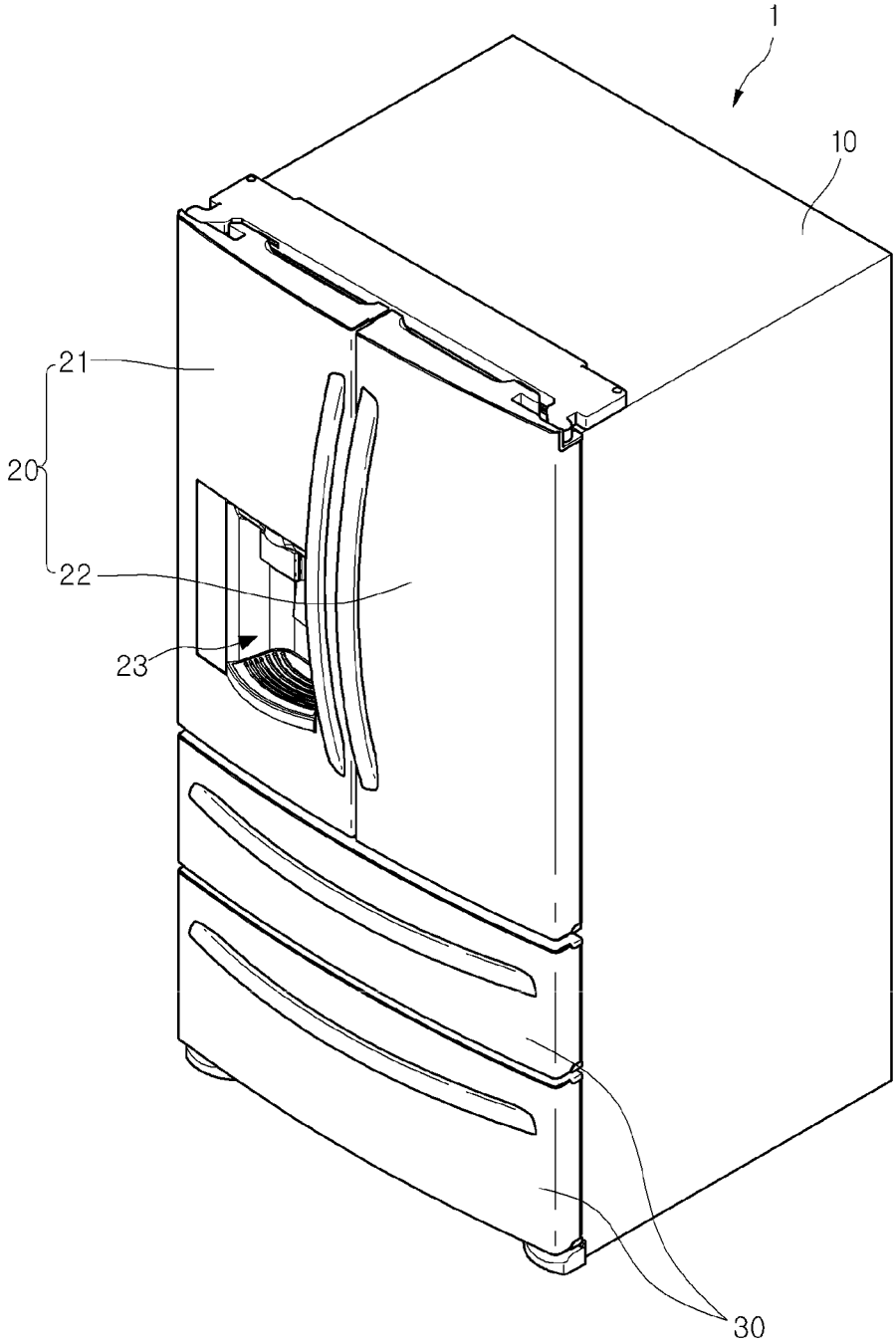
FIG. 1 is a perspective view of a refrigerator.
Figure 2:
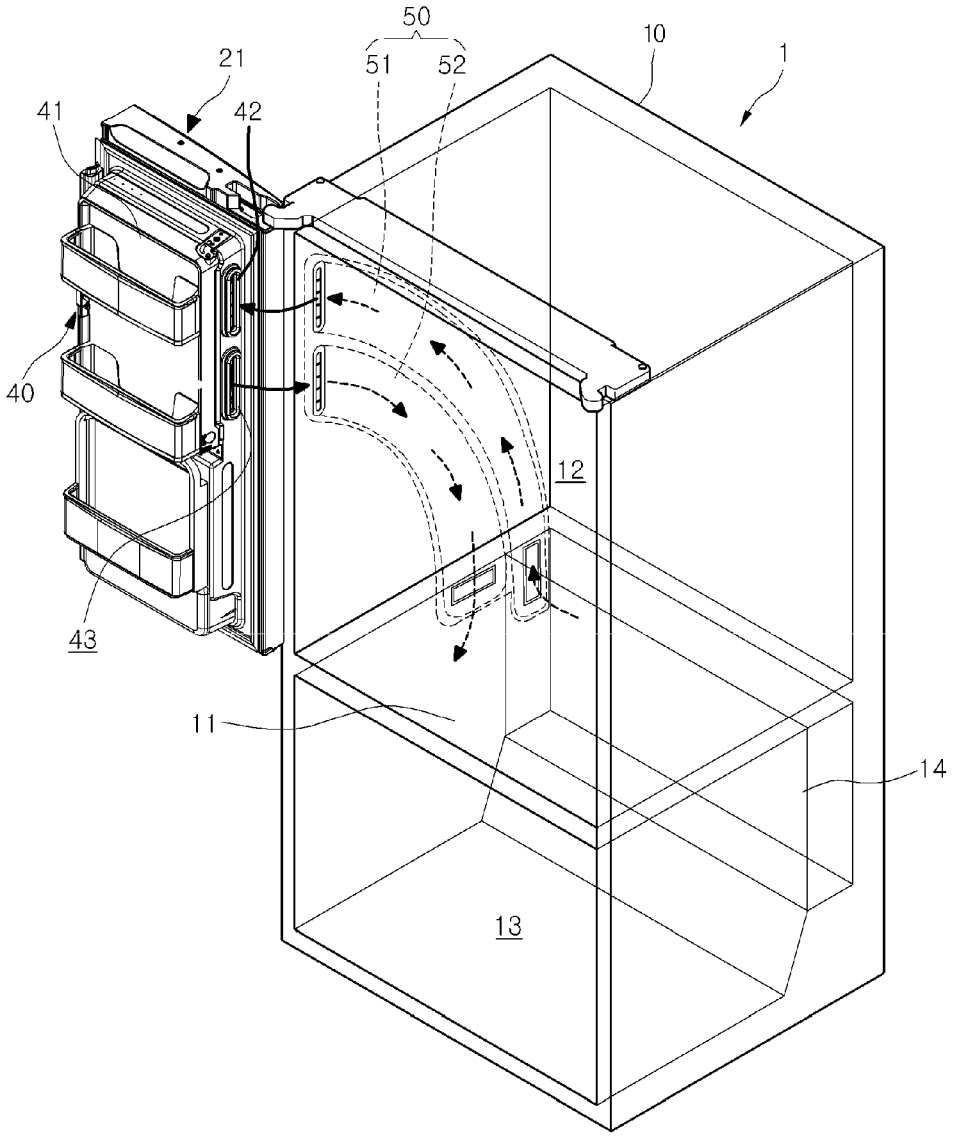
FIG. 2 is a perspective view illustrating a cool air circulation state within the inside of the refrigerator and an ice making compartment.

FIG. 1 illustrates an example refrigerator, and FIG. 2 illustrates a cool air circulation state within an inside of the example refrigerator and an example ice making compartment.

Referring to FIGS. 1 and 2, a refrigerator 1 includes a cabinet 10 defining a storage space and doors 20 and 30 openably mounted on the cabinet 10. Here, an outer appearance of the refrigerator 1 may be defined by the cabinet 10 and the doors 20 and 30.

The storage space within the cabinet 10 is vertically partitioned by a barrier 11. A refrigerating compartment 12 is defined in the partitioned upper side, and a freezing compartment 13 is defined in the partitioned lower side.

The doors 20 and 30 include a refrigerating compartment door 20 for opening or closing the refrigerating compartment 12 and a freezing compartment door 30 for opening or closing the freezing compartment 13. Also, the refrigerating compartment door 20 includes a plurality of doors on left and right sides thereof. The plurality of doors include a first refrigerating compartment door 21, and a second refrigerating compartment door 22 disposed at a right side of the first refrigerating compartment door 21. The first refrigerating compartment door 21 and the second refrigerating compartment door 22 are independently rotated with respect to each other.

The freezing compartment door 30 may be provided as a slidably withdrawable door. The freezing compartment door 30 includes a plurality of vertically disposed doors. The freezing compartment door 30 may be provided as one door as desired.

A dispenser 23 for dispensing water or ice pieces is disposed in one of the first refrigerating compartment door 21 and the second refrigerating compartment door 22. For example, a structure in which the dispenser 23 is disposed in the first refrigerating compartment door 21 is illustrated in FIG. 1.

An ice making compartment 40 for making and storing ice pieces is defined in the first refrigerating compartment door 21. The ice making compartment 40 is provided as an independent insulation space. The ice making compartment 40 may be opened or closed by an ice making compartment door 41. An ice maker for making ice pieces may be provided within the ice making compartment 40. Also, components for storing made ice pieces and dispensing the ice pieces through the dispenser 23 may be provided in the ice making compartment 40.

A cool air inlet 42 and a cool air outlet 43 which communicate with a cool air duct 50 disposed in the cabinet 10 when the first refrigerating compartment door 21 is closed are provided in one surface of the ice making compartment 40. Cool air introduced into the cool air inlet 42 cools the inside of the ice making compartment 40 to make ice pieces. Then, the heat-exchanged cool air is discharged to the outside of the ice making compartment 40 through the cool air outlet 43.

A heat exchange chamber 14 partitioned from the freezing compartment 13 is defined in a rear side of the freezing compartment 13. An evaporator is provided in the heat exchange chamber 14. Cool air generated in the evaporator may be supplied into the freezing compartment 13, the refrigerating compartment 12, and the ice making compartment 40 to cool the inside of each of the freezing compartment 13, the refrigerating compartment 12, and the ice making compartment 40.

Also, the cool air duct 50 for supplying cool air into the ice making compartment 40 and recovering the cool air from the ice making compartment 40 is disposed in a side wall of the cabinet 10. The cool air duct 50 extends from a side of the freezing compartment 13 to an upper portion of the refrigerating compartment 12. When the first refrigerating compartment door 21 is closed, the cool air duct 50 communicates with the cool air inlet 42 and the cool air outlet 43. Also, the cool air duct 50 communicates with the heat exchange chamber 14 and the freezing compartment 13.

Thus, cool air within the heat exchange chamber 14 is introduced into the ice making compartment 40 through a supply passage 51 of the cool air duct 50. Also, cool air within the ice making compartment 40 is recovered into the freezing compartment 13 through a recovery passage 52 of the cool air duct 50. Also, ice pieces are made and stored within the ice making compartment 40 by continuous circulation of the cool air through the cool air duct 50.

In the refrigerator having the above-described structure, making and storage of ice pieces are performed within the ice making compartment 40 provided in the refrigerating compartment 12 to increase a volume of the refrigerating compartment door 20. Thus, a receiving space defined in a back surface of the refrigerating compartment door 20 may be reduced.

Also, cool air for making ice pieces may need to be supplied up to the ice making compartment. Thus, power consumption may be increased.

Figure 3:
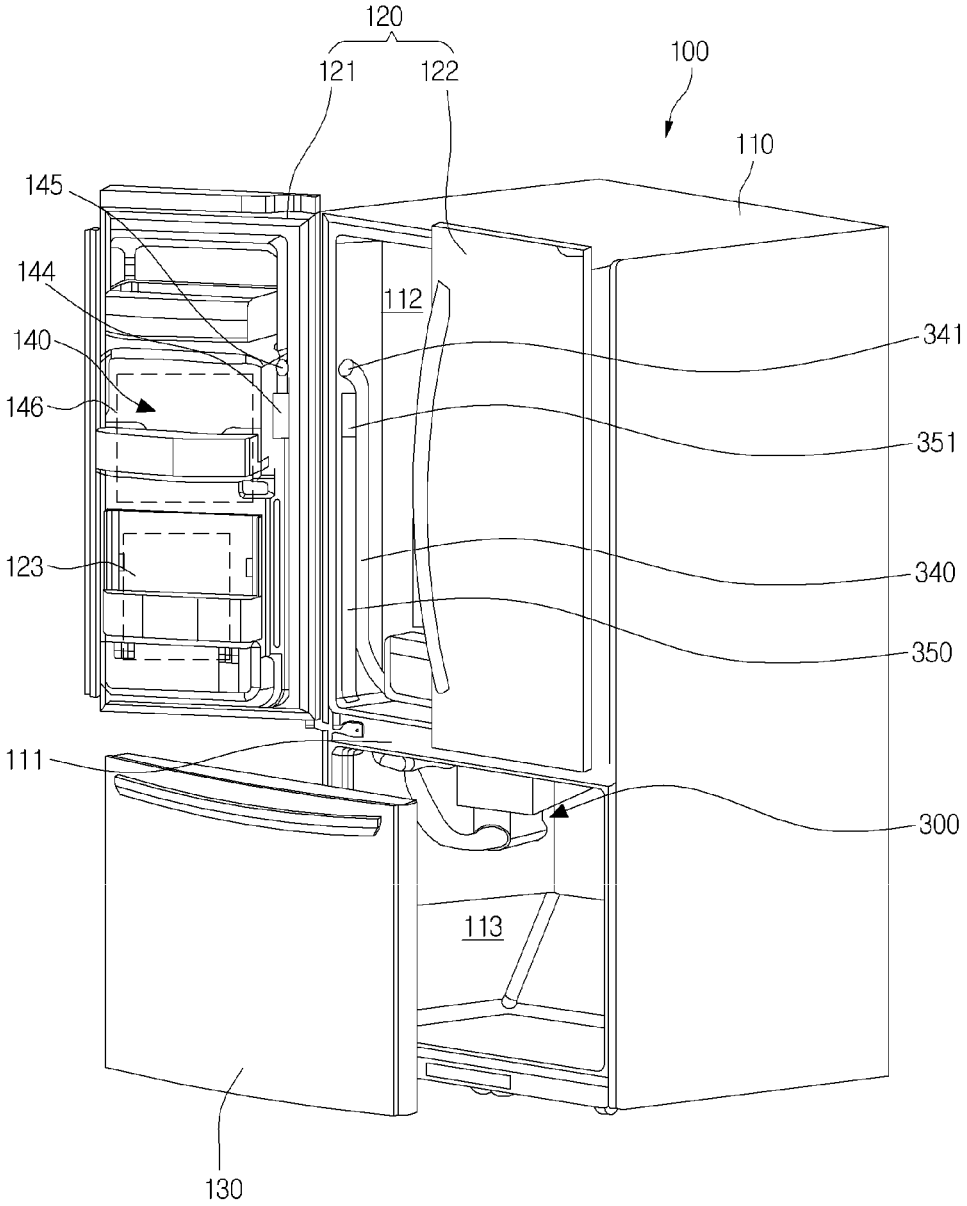
FIG. 3 is a perspective view of a refrigerator with a door opened.
Figure 4:
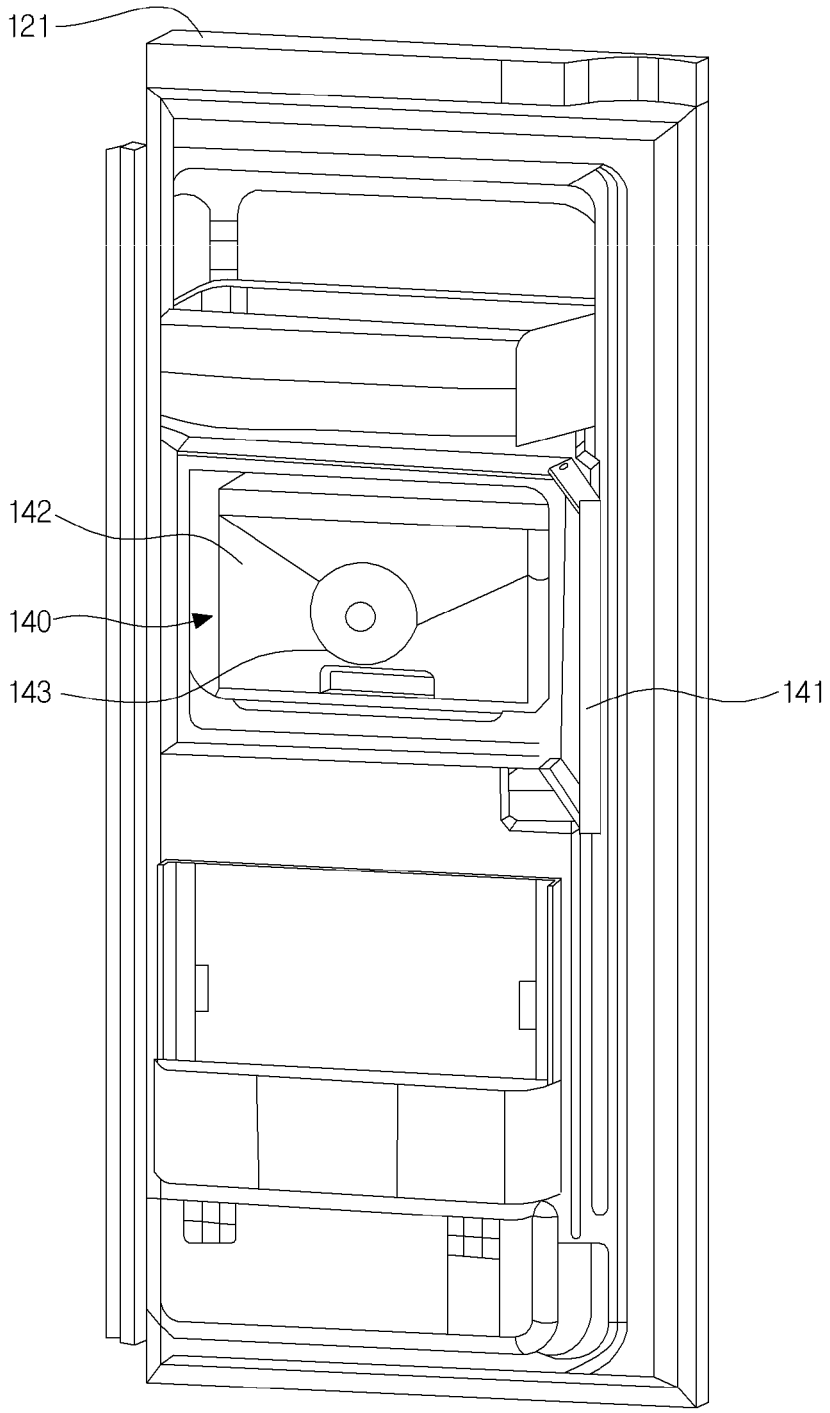
FIG. 4 is a perspective of an ice bank with a door opened.
Figure 5:
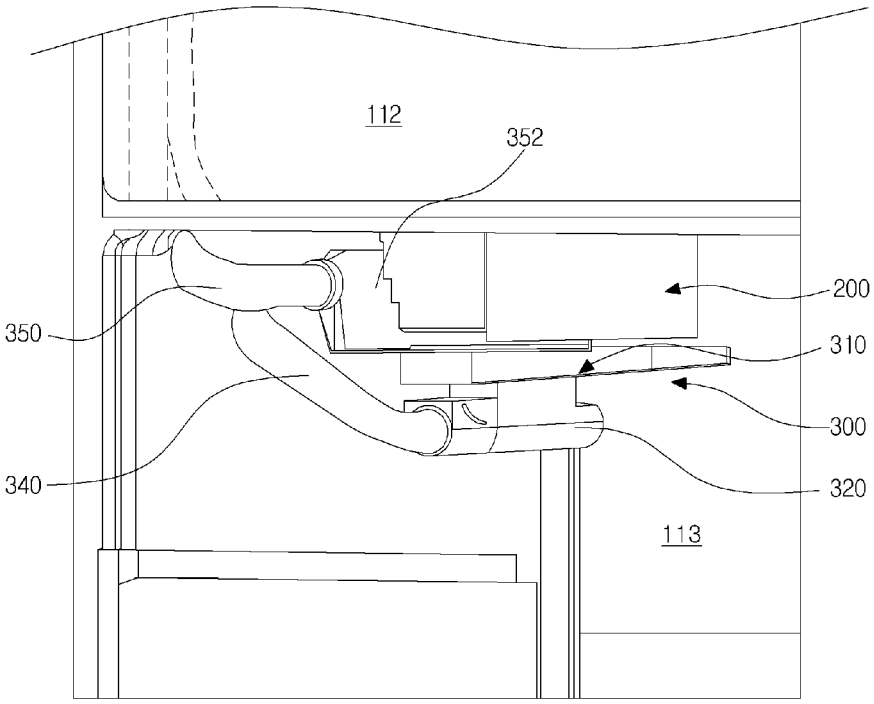
FIG. 5 is a partially perspective view illustrating the inside of a freezing compartment.

FIG. 3 illustrates an example refrigerator with a door opened. FIG. 4 illustrates an example ice bank with a door opened. FIG. 5 illustrates the inside of an example freezing compartment.

Referring to FIGS. 3 to 5, a refrigerator 100 includes a cabinet 110 and a door. Here, the cabinet 110 and the door define an outer appearance of the refrigerator 100. The inside of the cabinet 110 is partitioned by a barrier 111. That is, a refrigerating compartment 112 is defined at an upper side, and a freezing compartment 113 is defined at a lower side.

An ice maker 200 for making ice pieces and an ice transfer device 300 for transferring the made ice pieces into an ice bank 140 may be provided within the freezing compartment 113. An ice chute 340 constituting the ice transfer device 300 and openings 341 and 351 defined in ends of a cool air duct 350 are exposed to a sidewall of the refrigerating compartment 112.

In detail, the door includes a refrigerating compartment door 120 for covering the refrigerating compartment 112 and a freezing compartment door 130 for covering the freezing compartment 113. The refrigerating compartment door 120 includes a first refrigerating compartment door 121 and a second refrigerating compartment door 122 which are respectively disposed on left and right sides. The first and second refrigerating compartment doors 121 and 122 are independently rotated with respect to each other. Also, the first and second refrigerating compartment doors 121 and 122 may partially or wholly cover the refrigerating compartment 112. Also, the freezing compartment door 130 may be slidably withdrawn in front and rear directions to open or close the freezing compartment 113.

A dispenser 123 may be provided in a front surface of the first refrigerating compartment door 121. Water supplied from a water supply source and ice pieces made in the ice maker 200 (that will be described below in more detail) may be dispensed to the outside of the refrigerating compartment door 120 through the dispenser 123.

An ice bank 140 is provided at (e.g., in, on, etc.) a back surface of the first refrigerating compartment door 121. The ice bank 140 provides a space for storing ice pieces transferred by the ice transfer device that will be described below in more detail. The ice bank 140 provides a thermally insulative space. Also, the ice bank 140 is selectively opened or closed by an ice bank door 141. When the first refrigerating compartment door 121 is closed, the ice bank 140 is connected to the ice chute 340 and the cool air duct 350. Also, ice pieces may be supplied through the ice chute 340, and cool air may return into the freezing compartment 113 through the ice chute 340. Also, cool air may be supplied into the ice bank 140 by the cool air duct 350.

The ice bank 140 communicates with the dispenser 123. Thus, when the dispenser 123 is manipulated, ice pieces stored in the ice bank 140 may be dispensed. Also, a separate case 142 for receiving ice pieces may be provided within the ice bank 140. Also, an auger 143 configured to smoothly transfer ice pieces and a blade for crushing ice pieces prior to dispensing may be further provided within the ice bank 140.

The ice bank 140 protrudes from a back surface of the first refrigerating compartment door 121. Thus, when the first refrigerating compartment door 121 is closed, the ice bank 140 contacts an inner sidewall of the refrigerating compartment 112. An air hole 144 and an ice inlet hole 145 may be further defined in a sidewall of the ice bank 140 corresponding to the openings 341 and 351. Thus, when the first refrigerating compartment door 121 is closed, the made ice pieces and the cool air for maintaining the ice pieces may be supplied into the ice bank 140.

A withdrawable drawer, the ice maker 200, and the ice transfer device 300 may be disposed inside the freezing compartment 113.

The ice maker 200 is configured to make ice pieces using water supplied from the water supply source. The ice maker 200 may be disposed on an upper portion of a left side of the freezing compartment 113. The ice maker 200 is fixedly mounted on a bottom surface of the barrier 111. The ice pieces made in the ice maker 200 drop downward and then are temporarily received in an ice bin 310 disposed above the ice transfer device 300. The ice transfer device 300 and the ice bank 140 communicate with each other by the ice chute 340.

Here, the positions of the ice maker 200 and the ice transfer device 300 may be determined by the position of the ice bank 140. For example, if the ice bank 140 is disposed in the first refrigerating compartment door 121, the ice transfer device 300 may be disposed on an upper portion of a left side of the freezing compartment 113 so that a distance between the ice transfer device 300 and the ice bank 140 is minimized.

The ice transfer device 300 may be fixedly mounted on the sidewall of the freezing compartment 113 at a lower side of the ice maker 200. The ice transfer device 300 includes the ice bin 310, a driving unit 330 (see FIG. 7) for pushing ice pieces toward the ice chute 340, and a housing 320 configured to receive the driving unit 330.

In detail, an inlet port of the ice chute 340 may be connected to a front end of the housing 320 to transfer ice pieces made in the ice maker 200 into the ice bank 140 through the ice chute 340. A structure of the ice transfer device 300 will be described in more detail below.

The cool air duct 350 is disposed on a side of the ice transfer device 300. The cool air duct 350 is configured to supply the cool air within the freezing compartment into the ice bank 140. An entrance of the cool air duct is exposed to the inside of the freezing compartment 113. Also, a cool air supply part 352 including a blow fan may be further provided on the inlet port of the cool air duct 350. The cool air supply part 352 may communicate with an evaporation chamber.

Figure 6:
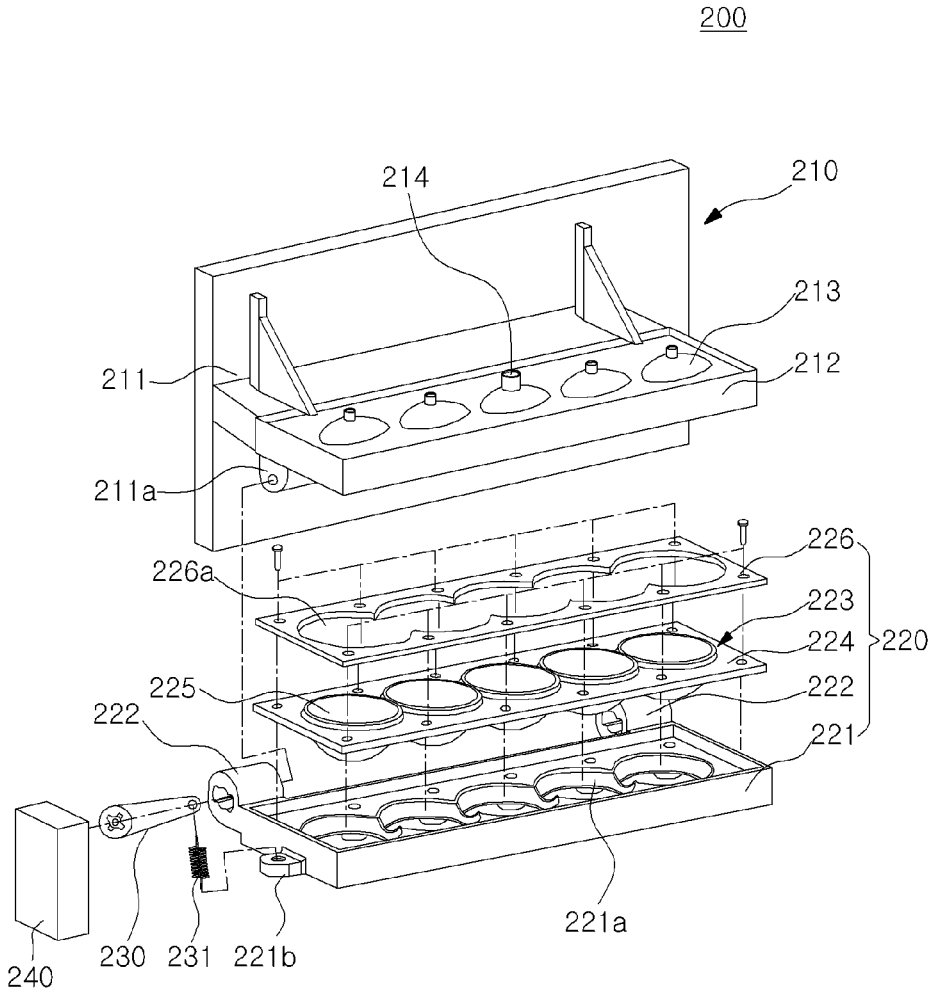
FIG. 6 is an exploded perspective view of an ice maker.

Hereinafter, an example structure of the ice maker 200 will be described in more detail with reference to the accompanying drawings. The ice maker 200 may be designed to make a globular or spherical ice. FIG. 6 illustrates an example ice maker.

Referring to FIG. 6, the ice maker 200 may be mounted on a bottom surface of the barrier 111. The ice maker 200 includes an upper tray 210 defining an upper appearance, a lower tray 220 defining a lower appearance, a motor assembly for operating one of the upper tray 210 and the lower tray 220, and an ejecting unit for separating ice pieces made on the upper or lower tray 210 or 220.

In detail, the lower tray 220 has a substantially square shape when viewed from an upper side. A recess part 225 recessed downward is defined inside the lower tray 220. A lower half of a globular or spherical ice piece is made in the recess part 225. The lower tray 220 may be formed of a metal material. As needed, a portion of the lower tray 220 may be formed of an elastic material. In some examples, the recess part 225 may be formed of an elastically deformable material.

The lower tray 220 includes a tray case 221, a tray body 223 seated on the tray case 221 and having the recess parts 225 arranged therein, and a tray cover 226 for fixing the tray body 223 to the tray case 221.

The tray case 221 may have a square frame shape. Also, the tray case 221 may further extend upward and downward along a circumference thereof. Also, a seat part **221*a* punched in a circular shape is disposed within the tray case 221. The seat part 221*a* may be closely attached to an outer surface of the recess part 225. In detail, the inner surface of the seat part 221*a* may be rounded so that the recess part 225 having a hemispherical shape may be stably and closely attached thereto. The seat part 221*a* may be provided in plurality to correspond to the position and shape of the recess part 225. Thus, the plurality of seat parts 221*a*** may be connected to each other.

An upper tray connection part 222 is disposed on each of both edges of a rear surface of the tray case 221. The upper tray 210 and the motor assembly 240 are coupled to the upper tray connection part 222. An elastic member 231 for providing an elastic force so that the lower tray 220 is closely attached to the upper tray 210 is connected to one side surface of the tray case 221. In detail, an elastic member mounting part 221*b* protrudes from a side surface of the tray case 221. An end of the elastic member 231 is connected to the elastic member mounting part 221*b*.

The whole tray body 223 or the recess part 225 may be formed of an elastically deformable flexible material. The tray body 223 is seated on a top surface of the tray case 221. The tray body 223 includes a plane part 224 and the recess part 225 recessed downward from the inside of the plane part 224.

The plane part 224 has a plate shape with a predetermined thickness. Also, the plane part 224 may have a shape to correspond to that of the top surface of the tray case 221 so that the plane part 224 is received into the tray case 221. Also, the recess part 225 may have the hemispherical shape. Alternatively, the recess part 225 may have a shape corresponding to that of a recess part 213 (that will be described in more detail below) of the upper tray 210. Thus, when the upper and lower trays 210 and 220 are closely attached to each other, the recess parts 225 and 213 may form a globular or spherical shell.

The recess part 225 may pass through the seat part 221*a* of the tray case 221 to protrude downward. Thus, the recess part 225 may be pushed by the ejecting unit when the lower tray 220 is rotated. As a result, an ice piece within the recess part 225 may be separated to the outside. Also, a lower protrusion protruding upward is disposed on a circumference of the recess part 225. When the upper tray 210 and the lower tray 220 are closely attached to each other, the lower protrusion may overlap with an upper protrusion of the upper tray 210 to reduce water leakage.

Also, the tray cover 226 is seated on a top surface of the tray body 223. Thus, the tray body 223 is fixed to the tray case 221. Also, a coupling member such as a screw or rivet successively passes through the tray cover 226, the tray body 223, and the tray case 221 to complete the lower tray 220.

A punched part 226*a* having a shape corresponding to that of an opened top surface of the recess part 225 is defined in the tray cover 226. The punched part 226*a* may have a shape in which a plurality of circular holes successively overlap with each other. Thus, when the lower tray 220 is completely assembled, the recess part 225 is exposed through the punched part 226*a*, and the lower protrusion is disposed inside the punched part 226*a*.

The upper tray 210 defines an upper appearance of the ice maker 200. The upper tray 210 may include a mounting part 211 for mounting the ice maker 200 and a tray part 212 for making ice pieces.

In detail, the mounting part 211 is configured to mount the ice maker 200 inside the freezing compartment 113. The mounting part 211 may extend in a vertical direction perpendicular to that of the tray part 212. Thus, the mounting part 211 may surface-contact a side surface of the freezing compartment 113 or a side surface of an ice maker case for receiving the ice maker 200.

Also, a plurality of recess parts 213 recessed in a hemispherical shape may be provided in the tray part 212. The recess parts 213 are successively arranged in a line. An upper half of a globular or spherical ice piece may be formed in each of the recess parts 213. When the upper tray 210 and the lower tray 220 are closely attached to each other, the recess part 225 of the lower tray 220 and the recess part 213 of the upper tray 210 are closely attached to each other to form a globular or spherical shell.

A shaft coupling part 211*a* to which the lower tray connection part 222 is shaft-coupled may be further disposed on a rear side of the tray part 212. The shaft coupling part 211*a* protrudes from both edges of a rear bottom surface of the tray part 212 and is shaft-coupled to the lower tray connection part 222. Thus, the lower tray 220 is rotatably connected to the upper tray 210. Also, the lower tray 220 is closely attached to the upper tray 210 or separated from the upper tray 210 while the lower tray 220 is rotated by the rotation of the motor assembly 240. Here, a state in which the lower tray 220 is closely attached to the upper tray 210 may be defined as a state in which the tray is closed. Also, a state in which the lower tray 220 is rotated and thus separated from the upper tray 210 may be defined as a state in which the tray is opened.

The upper tray 210 may be formed of a metal material. Thus, the upper tray 210 may be configured to quickly freeze water within the globular or spherical shell. Also, an ice separation heater for heating the upper tray 210 to separate ice pieces from the upper tray 210 may be further provided on the upper tray 210. The ice separation heater may have a U shape. Also, the ice separation heater may contact an outer surface of each of the recess parts 213.

Also, air holes 214 for supplying water and discharging air within the shell is defined in the recess parts 213 of the upper tray 210, respectively. One of the air holes 214 may serve as a water supply part through which water supplied from a water supply tray or a water supply tube passes. In some implementations, a middle air hole 214 serves as the water supply part. The middle air hole 214 serving as the water supply part may have a diameter or length greater than those of the other air holes.

Like the lower tray 220, the recess part 213 of the upper tray 210 may be formed of an elastic material. In this case, an ejecting pin for pressing a top surface of the recess part 213 instead of the ice separation heater may be provided above the upper tray.

A rotating arm 230 and the elastic member 231 are disposed on a side of the lower tray 220. The rotating arm 230 may be provided for the tension of the elastic member 231. The rotating arm 230 may be rotatably mounted on the lower tray 220.

The rotating arm 230 has one end shaft-coupled to the lower tray connection part 222 and the other end connected to the other end of the elastic member 231. The rotating arm 230 may be further rotated by a predetermined angle in a state where the lower tray 220 is closely attached to the upper tray 210 to expand the elastic member 231. Thus, the upper tray 220 may strongly press the upper tray 210 by a restoring force of the elastic member 231 to reduce water leakage.

The motor assembly 240 is disposed on a side of the upper and lower trays 210 and 220. A rotation shaft of the motor assembly 240 is connected to a rotation shaft passing through the upper tray connection part 222. Also, the motor assembly 240 may further include a deceleration gear in which a plurality of gears are combined with each other to adjust a rotation rate of the lower tray 220.

Figure 7:
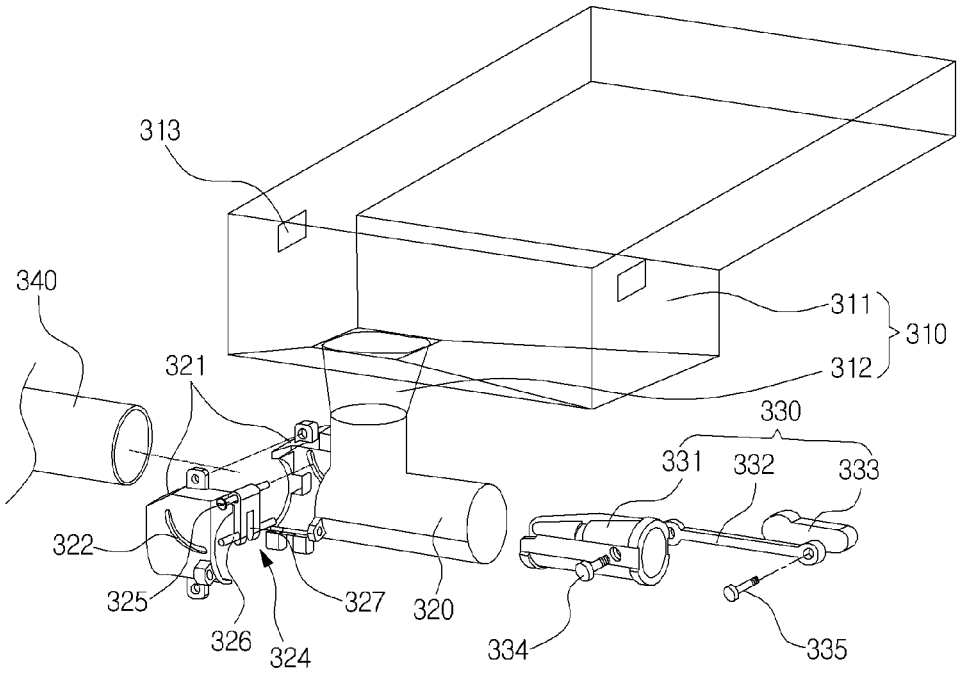
FIG. 7 is an exploded perspective view of an ice transfer device.
Figure 8:
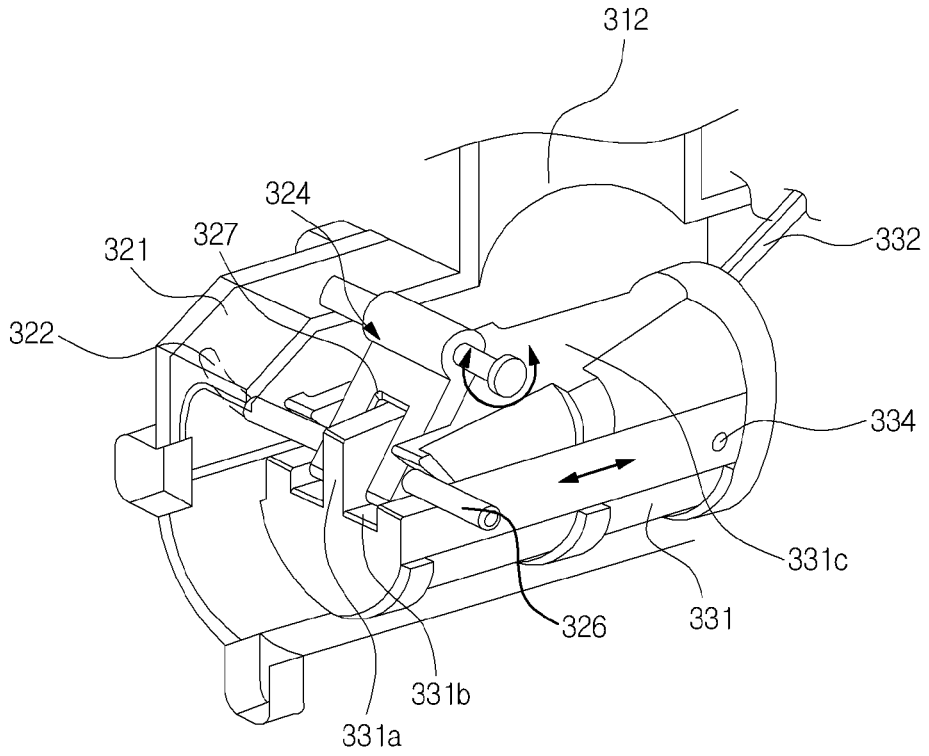
FIG. 8 is a partially cut-away perspective view of the ice transfer device.

Hereinafter, an example ice transfer device will be described in more detail with reference to the accompanying drawings. FIG. 7 illustrates an example ice transfer device. FIG. 8 is a partially cut-away perspective view of the example ice transfer device.

Referring to FIGS. 7 and 8, the ice transfer device 300 may be connected to the ice bank 140 and may transfer ice pieces to the ice bank 140 through the freezing compartment 113, the refrigerating compartment 112, and the first refrigerating compartment door 121. Thus, ice pieces made in the ice maker 200 may be supplied into the ice bank 140.

The ice transfer device 300 may be mounted within an inner case 115 (see FIG. 9) defining an inner surface of the cabinet 110 and be exposed to the inside of the refrigerator. Here, the ice transfer device 300 may be mounted on a member such as a separate bracket coupled to the inner case 115. Also, at least one portion of the ice transfer device 300 may be buried within an insulation material between an outer case 114 and the inner case 115 of the cabinet 110 to provide insulation properties.

The ice transfer device 300 includes an ice bin 310 in which ice pieces dropping from the ice maker 200 are collected and stored, a driving unit 330 reciprocated to push and move ice pieces forward, a housing 320 receiving a portion of the driving unit 330, a shutter 324 disposed on a front end of the housing 320 to assist the discharge of ice pieces, a shutter cover 321 in which the shutter 324 is received, and an ice chute 340 connected to the shutter cover 321 to transfer ice pieces.

The ice bin 310 is disposed under the ice maker 200. The ice bin 310 may include a storage part 311 for storing ice pieces and a connection part 312 connecting the storage part 311 to the housing 320.

The storage part 311 is opened upward to receive ice pieces dropping downward from the ice maker 200. Also, the storage part 311 may have a predetermined volume. The storage part 311 may have an inclined bottom surface. Thus, the ice pieces stored in the storage part 311 are rolled or slid toward the connection part 312.

The connection part 312 provides a passage connecting the storage part 311 to the housing 320. Also, the connection part 312 guides ice pieces so that the ice pieces within the storage part 311 are introduced into the housing 320. Thus, an inlet of the connection part 312 connected to the storage part 311 may be relatively wide, and an outlet of the connection part 312 may have a size slightly greater than that of a globular or spherical ice piece.

The housing 320 is connected to the connection part 312. Also, the housing 320 may extend in a direction crossing an extension direction of the connection part 312. The housing 320 has a cylindrical shape. Also, a piston 331 constituting the driving unit 330 is reciprocatedly mounted within the housing 320. The housing 320 may have an inner diameter corresponding to a diameter of the ice so that the globular or spherical ice pieces are arranged in a line.

The driving unit 330 includes a piston 331 provided within the housing 320, a motor 336 (see FIGS. 10 and 11) providing a rotation force, and first and second links 332 and 333 link-coupled to the motor 336 and the piston 331 to convert a rotation motion of the motor 336 into a linear motion.

In detail, the piston 331 is moved in front and rear directions to push ice pieces supplied into the housing 320 forward. That is, the piston 331 is disposed within the housing 320 and has a predetermined diameter so that the piston 331 is movable in the front and rear directions.

Also, a protrusion rib 331*a* protruding upward and a receiving groove 331*b* recessed from each of both sides of the protrusion rib 331*a* are provided at a center of a front end of the piston 331. The protrusion rib 331*a* and the receiving groove 331*b* are lengthily disposed in front and rear directions. When the piston 331 is moved, the protrusion rib 331*a* and the receiving groove 331*b* are configured to guide the rotation of the shutter 324.

Also, an inclined surface 331*c* is disposed on a top surface of the piston 331. The inclined surface 331*c* may be gradually increased in height from a front end toward a rear end of the piston 331. Also, the inclined surface 331*c* may be disposed to face an opened outlet of the connection part 312. Thus, ice pieces introduced from the connection part 312 to the housing 320 may be guided toward a front side of the piston 331 along the inclined surface 331*c*. That is, when the piston 331 is moved in the rear direction, the inclined surface 331*c* guides ice pieces so that the ice pieces are rolled downward into a space defined between the shutter 324 and the inclined surface 331*c*.

An end of the first link 332 is rotatably coupled to a rear end of the piston 331 by a coupling shaft 334. The first link 332 extends by a predetermined length. The first link 332 has the other end rotatably coupled to an end of the second link 333 outside the housing 320 by a link shaft 335. The second link 333 has the other end coupled to a rotation shaft of the motor 336.

Thus, when the motor 336 is operated, the second link 333 is rotated. As the second link 333 is rotated, the end of the first link 332 connected to the second link 333 is rotated also with respect to a rotation center of the second link 333 as a shaft. Here, the piston 331 is received into the housing 320. Thus, the end of the first link 332 connected to the piston 331 pushes and moves the piston 331 in front and rear directions. That is, the rotation motion of the motor 336 is converted into the linear motion by the first and second links 332 and 333 to move the piston 331 at a constant stroke in the front and rear directions.

The shutter cover 321 is disposed on a front end of the housing 320. The shutter 324 is received in the shutter cover 321.

The shutter cover 321 is coupled to the housing 320 to form a portion of the housing 320. The shutter cover is coupled to each of both sides of the housing 320 to connect the front end of the housing 320 to the ice chute 340 so that the housing 320 and the ice chute 340 communicate with each other. A guide slit 322 for guiding the rotation of the shutter 324 is defined in each of both left and right sides of the shutter cover 321. The guide slit 322 has an arc shape along a rotation trace of the shutter 324. Also, a guide protrusion 326 that will be described in more detail below may be inserted into the guide slit 322.

The shutter 324 vertically covers at least one portion of an inner space of the shutter cover 321 to restrict movement of ice pieces. The shutter 324 may have a plate shape with a predetermined width. An upper end of the shutter 324 is rotatably coupled to the shutter cover 321 by a shutter shaft 325.

Also, a shutter groove 327 recessed upward is defined in a lower end of the shutter 324. The shutter groove 327 has a shape to correspond to the protrusion rib 331*a* so that the protrusion rib 331*a* of the piston 331 is inserted when the piston is moved forward. Also, each of both sides of a lower end of the shutter 324 with respect to the shutter groove 327 may be inserted into the receiving groove 331*b* defined in the piston 331. Thus, when the piston 331 is moved, the shutter 324 may be stably rotated without being horizontally shaken by the protrusion rib 331*a* and the receiving groove 331*b*.

The guide protrusion 326 extending laterally is disposed on each of both side surfaces of the shutter 324. The guide protrusion 326 is disposed on a lower portion of the shutter 324. Also, the guide protrusion 326 extends by a predetermined length to pass through the guide slit 322.

Here, the guide slit 322 has a trace that guides rotation from a state in which the shutter 324 vertically stands up to a state in which the shutter 324 is horizontally disposed. Thus, ice pieces that pass through the shutter 324 and move forward within the housing 320 are blocked by the shutter 324 in the state where the shutter 324 is moved to vertically stand, thereby blocking the ice pieces from being moved backward. Thus, even though the piston 331 is reciprocated to generate a space at a front side of the piston 331, the forwardly moved ice pieces are not moved again backward by the shutter 324.

The ice chute 340 extends from a side of the housing 320 up to the first refrigerating compartment door 121 on which the ice bank 140 is mounted. Thus, the ice chute 340 may have a hollow tube shape so that ice pieces are transferred therethrough. Here, the ice chute 340 may have an inner diameter corresponding to that of a globular or spherical ice piece or slightly greater than that of the globular or spherical ice piece. Thus, the made ice pieces may be successively transferred in a line.

The ice chute 340 may extend to pass through the barrier 111. Also, the ice chute 340 may be mounted so that the chute 340 is exposed to the outside of the freezing compartment 113 and the refrigerating compartment 112. Here, an insulation member may be further provided outside the ice chute 340 to reduce heat-exchange between the refrigerating compartment 112 and the ice chute 340.

The ice chute 340 may be disposed between the outer case 114 and the inner case 115. That is, the ice chute 340 may be disposed within a sidewall of the cabinet 110 corresponding to the first refrigerating compartment door 121. Here, the ice chute 340 may be thermally insulated by the insulation material within the cabinet 110 and not be exposed to the inside of the refrigerator.

The ice chute 340 may extend up to an inner wall of the refrigerating compartment 112 corresponding to a position of the ice bank 140. An opening 341 opened to the inner sidewall of the refrigerating compartment 112 is defined in an upper end of the ice chute 340.

Thus, when the first refrigerating compartment door 121 is closed, the ice bank 140 and the ice chute 340 may communicate with each other. Thus, ice pieces may be moved along the ice chute 340 by the operation of the driving unit 330 and supplied into the ice bank 140.

The cool air duct 350 is disposed along the refrigerating compartment 112 at a side of the freezing compartment 113. Also, the cool air duct 350 may be buried within the cabinet 110, like the ice chute 340. The cool air duct 350 communicates with the ice bank 140 in the state where the first refrigerating compartment door 121 is closed to supply cool air within the freezing compartment 113 into the ice bank 140. Thus, the cool air supplied into the cool air duct 350 cools the inside of the ice bank 140. Then, the cool air may return into the freezing compartment 113 through the ice chute 340 to realize the circulation of the cool air.

Figure 9:
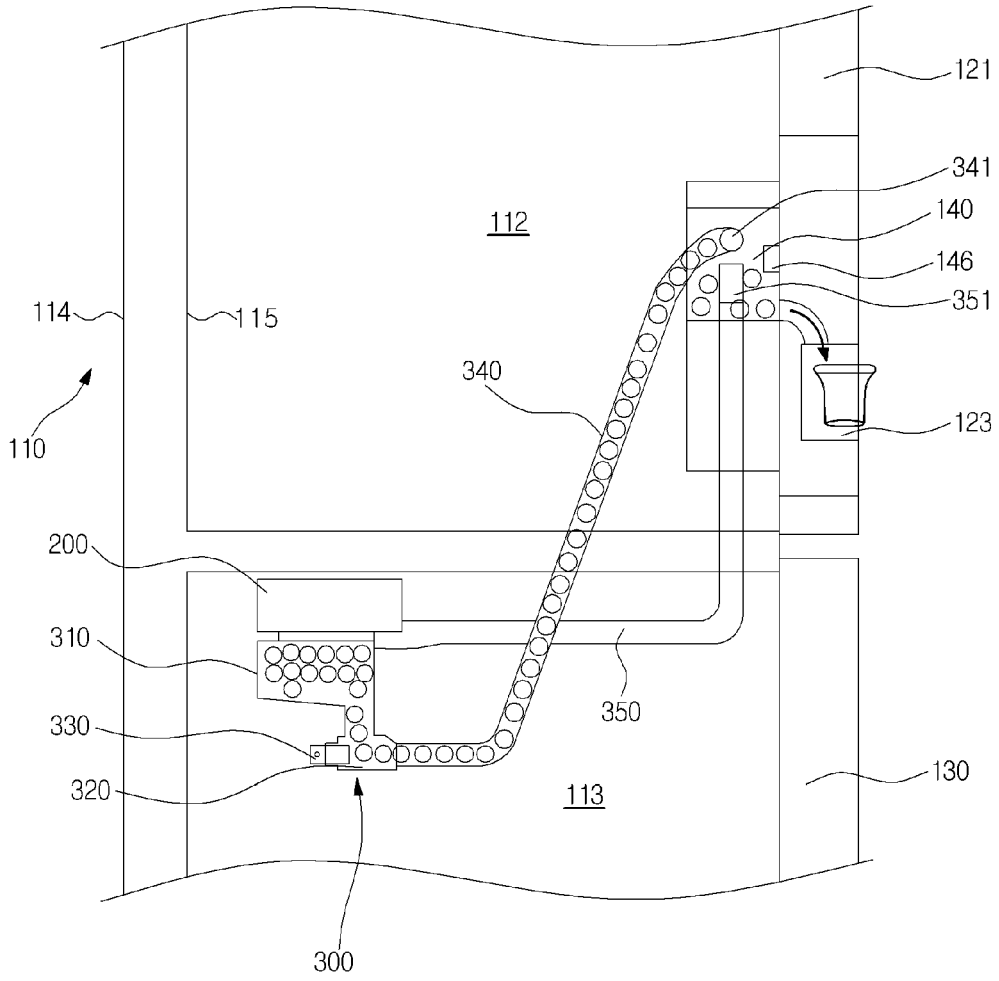
FIG. 9 is a schematic view illustrating an ice transfer state through the ice transfer device.

Hereinafter, an example operation of the example refrigerator including the above-described example components will be described with reference to the accompanying drawings. FIG. 9 illustrates an example ice transfer state through the example ice transfer device. FIGS. 10 to 13 illustrate an example operation of the example ice transfer device.

Referring to FIG. 9, when the refrigerator 1 is operated, cool air generated in the evaporator is supplied into the ice maker 200 provided inside the freezing compartment 113. Globular or spherical ice may be made inside the ice maker 200 using water supplied into the ice maker 200. When the ice pieces are completely made, the ice pieces drop down by a heater provided in the ice maker 200 or a component for separating the ice pieces.

The ice bin 310 is disposed under the ice maker 200. Thus, the globular or spherical ice pieces made in the ice maker 200 are supplied into the ice bin 310. The ice pieces stored in the storage part 311 of the ice bin 310 are supplied into the housing 320 through the connection part 312. Then, the ice pieces are moved forward by the piston 331 and supplied into the ice chute 340.

Figure 10:
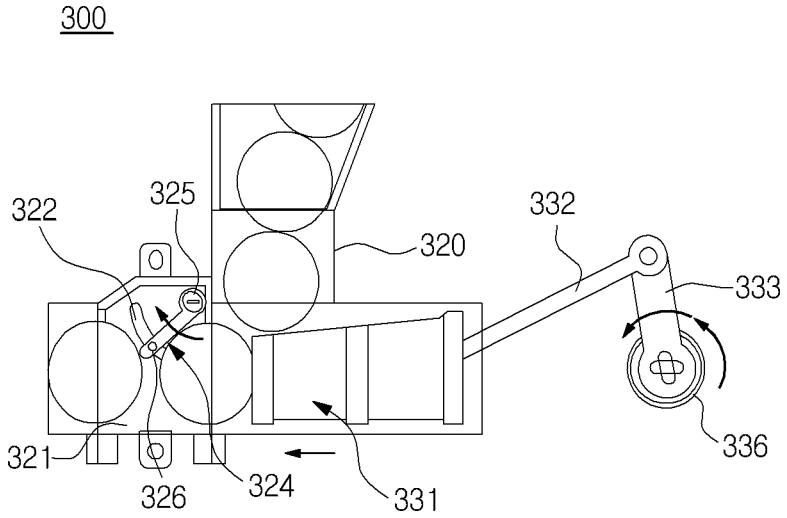
FIGS. 10 to 13 are views successively illustrating an operation of the ice transfer device.

In more detail, as shown in FIG. 10, the globular or spherical ice pieces stored in the storage part 311 are introduced into the housing 320 through the connection part 312. Here, the ice pieces are disposed in a space between the shutter 324 and the front end of the piston 331.

Figure 11:
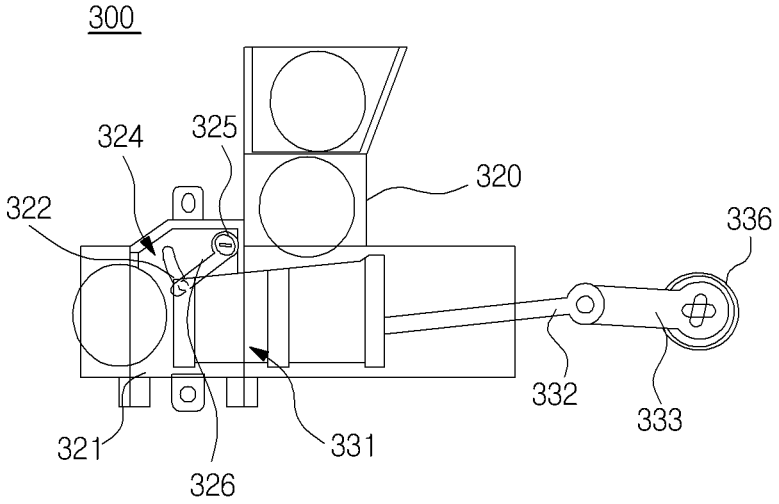

In this state, when the motor 336 is rotated in a counterclockwise direction, the second link 333 is rotated. Thus, the piston 331 is moved forward by the first link 332. Thus, the piston 331 pushes the ice pieces in the front direction. Here, the ice pieces push the shutter 324 to rotate the shutter in a clockwise direction. As shown in FIG. 11, the ice pieces pass through the shutter cover 321 into a space defined by the rotation of the shutter 324. The ice pieces received in the shutter cover 321 and the ice chute 340 may be successively pushed forward.

Figure 12:
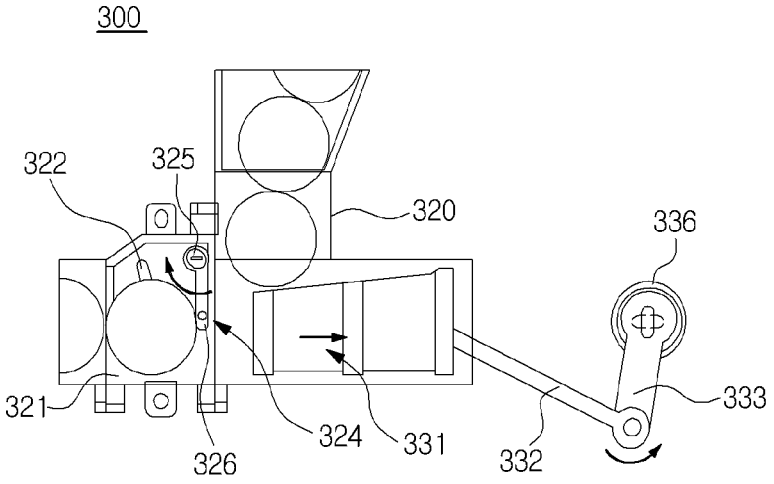

As shown in FIG. 11, when the motor 336 is further rotated in the counterclockwise direction in a state where the piston 331 is completely moved forward, the piston 331 is moved backward as shown in FIG. 12. Here, while the shutter 324 is in contact with the front end of the piston 331, when the piston 331 is moved backward, the shutter 324 is rotated in the counterclockwise direction by its self-weight.

Figure 13:
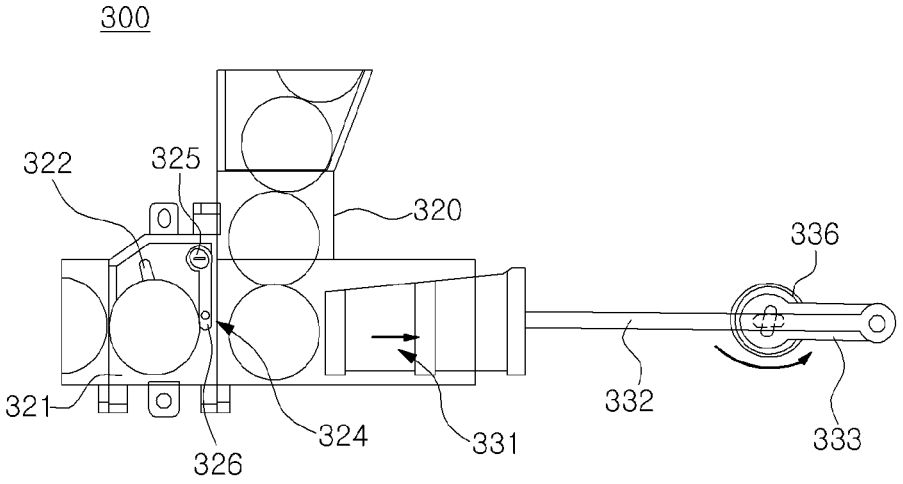

As shown in FIG. 13, when the motor 336 is further rotated, the shutter 324 completely descends and is spaced from the piston 331. In this state, the shutter 324 covers a portion of the inside of the housing 320 or the shutter cover 321 to block the ice pieces disposed at a front side of the shutter 324 from being moved backward. Also, when the motor 338 is further rotated in FIG. 13, the piston 331 is further moved backward. Thus, a space is defined between the shutter 324 and the piston 331 to receive an ice piece within the storage part 311 into the housing 320. In this state, when the motor 336 is further rotated, the piston 331 is moved again forward.

Thus, when the second link 333 is rotated once, the piston 331 is moved in the front and rear directions. Thus, when one cycle is completed, one ice piece may be moved forward. The above-described processes may be successively repeated to continuously supply the ice pieces into the ice chute 340. As the operation of the driving unit 330 as described above, the ice pieces within the ice chute 340 may be successively pushed and discharged into the ice bank 140.

The ice pieces discharged into the ice bank 140 are stored in the ice bank 140. The ice pieces stored in the ice bank 140 may be dispensed through the dispenser 123 when the dispenser 123 is manipulated.

Also, a full ice detection device 146 may be provided in the ice bank 140. Also, a full ice detection device 313 may be additionally provided inside the ice bin 310. A set amount or more of ice pieces may be filled into the ice bank 140 and the ice bin 310 by the full ice detection device pieces 146 and 313 disposed in the ice bank 140 and the ice bin 310. Also, the operation of the ice maker 200 may be controlled by the full ice detection device pieces 146 and 313 until the set amount or more of ice pieces are fully filled. In this state, the driving unit 330 may be operated to supply the ice pieces into the ice bank 140.

When a user manipulates the dispenser 123 in a state where the ice bank 140 is fully filled with ice pieces, the ice pieces stored in the ice bank 140 may be dispensed to the outside through the dispenser 123.

Here, since the globular or spherical ice pieces are dispensed through the dispenser 123, the user may dispense a desired number of ice pieces by manipulating the dispenser 123.

The operation of the driving unit 330 may be restricted by a door sensor for detecting an opening/closing of the refrigerating compartment door 120. That is, when the user manipulates the dispenser 123 in a state where the refrigerating compartment door 120 is opened, the driving unit 330 may not be operated to stop ice pieces from being dispensed.

According to the proposed implementations, since the ice maker is disposed in the freezing compartment, it may be unnecessary to secure a separate space for receiving the ice maker in the refrigerating compartment door. Thus, a space for storing may be expanded in the back surface of the refrigerating compartment door while maintaining the dispensing convenience of ice pieces. Thus, the storage capacity of the refrigerator may be expanded while maintaining convenience of use.

Also, since ice pieces are made in the freezing compartment, it may be unnecessary to continuously supply strong cool air for making ice pieces into the refrigerating compartment door. Thus, cooling efficiency may be improved, and the power consumption may be reduced. Also, since ice pieces are made in the freezing compartment, ice making efficiency also may be improved.

Although implementations have been described with reference to a number of illustrative examples thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet comprising a refrigerating compartment and a freezing compartment;

a refrigerating compartment door configured to open and close at least a portion of the refrigerating compartment;

a dispenser disposed at the refrigerating compartment door and configured to dispense ice pieces;

an ice bank disposed at a back surface of the refrigerating compartment door to supply the ice pieces to the dispenser;

an ice maker disposed in the freezing compartment and configured to make the ice pieces; and an ice transfer device disposed in the freezing compartment and configured to transfer the ice pieces made by the ice maker to the ice bank, wherein the ice transfer device comprises:

a piston configured to push the ice pieces made by the ice maker;

an ice chute configured to guide the ice pieces pushed by the piston to the ice bank; and a storage member configured to store the ice pieces made by the ice maker, wherein a top surface of the piston is inclined in a manner that guides ice pieces transported from the storage member toward a front side of the piston that is appropriate for being pushed toward the ice chute by the piston.

2. The refrigerator according to claim 1, wherein the ice chute extends from the ice transfer device to the refrigerating compartment and communicates with the ice bank in a state where the refrigerating compartment door is closed.

3. The refrigerator according to claim 2, wherein the ice chute returns cool air supplied into the ice bank to the freezing compartment.

4. The refrigerator according to claim 3, further comprising a cool air duct that extends from the freezing compartment to the refrigerating compartment, that communicates with the ice bank in a state where the refrigerating compartment door is closed, that is disconnected from the ice bank in a state where the refrigerating compartment door is open, and that supplies cool air from within the freezing compartment to the ice bank.

5. The refrigerator according to claim 1, wherein at least one portion of the ice transfer device is positioned within an insulation material between an outer case defining an outer appearance of the cabinet and an inner case defining an inner space of the refrigerator.

6. The refrigerator according to claim 1, wherein the ice transfer device comprises:

a housing configured to receive an ice piece transported from the storage member, wherein the piston is positioned at least partially in the housing and reciprocates to push the ice piece received in the housing.

7. The refrigerator according to claim 6, wherein the driving unit comprises:

a motor configured to generate a rotation power; and a link member that connects the motor to the piston and that is configured to convert a rotation motion of the motor into a linear reciprocating motion that drives the piston.

8. The refrigerator according to claim 6, further comprising a shutter positioned within the housing and configured to selectively open and cover a front opening of the housing, the front opening of the housing being an opening through which ice pieces exit the housing when pushed toward the ice chute by the piston, wherein the shutter is rotated to open the front opening of the housing based on reciprocation of the piston.

9. The refrigerator according to claim 8, wherein the shutter is configured to block ice pieces that have exited the front opening of the housing from reentering the front opening of the housing.

10. The refrigerator according to claim 8, further comprising a rib that protrudes upward from a front end of the piston and that engages the shutter during reciprocation of the piston to guide rotation of the shutter in a direction that opens the front opening of the housing.

11. The refrigerator according to claim 10, wherein the shutter comprises:

a shutter groove in which the rib is received during reciprocation of the piston; and a guide protrusion extending from each of both sides surfaces, wherein a top surface of the piston has a receiving groove that is recessed from the top surface of the piston at each of left and right sides of the rib and that defines an insertion area in which an end of the shutter is inserted during reciprocation of the piston.

12. The refrigerator according to claim 1, wherein the ice maker comprises:

an upper tray comprising a plurality of hemispherical recess parts recessed upward; and a lower tray comprising a plurality of hemispherical recess parts recessed downward and being rotatably coupled to the upper tray, the lower tray being configured to attach to the recess parts of the upper tray to define a spherical shell.

13. The refrigerator according to claim 12, wherein the ice chute has a diameter that corresponds to a size of the spherical shell used in making ice pieces.

14. The refrigerator according to claim 4, further comprising a blow fan positioned at an inlet of the cool air duct and configured to promote movement of cool air into the ice bank.

15. The refrigerator according to claim 6, further comprising an ice detection device positioned in at least one of the ice bank and the storage member and configured to detect whether a set amount or more of the ice pieces is filled.

16. The refrigerator according to claim 1, further comprising a door sensor configured to detect opening or closing of the refrigerating compartment door, wherein an operation of the piston is restricted according to the opening or closing of the door detected by the door sensor.

17. The refrigerator according to claim 16, wherein the piston is disabled based on the door sensor detecting opening of the refrigerating compartment door.

18. The refrigerator according to claim 1:

wherein the dispenser is disposed in the refrigerating compartment door; and wherein the ice bank is disposed in the back surface of the refrigerating compartment door.

* * * * *